United States Patent [19]

Jopling

[11] 4,411,559

[45] Oct. 25, 1983

[54] MINING SYSTEM

[76] Inventor: Aunald Jopling, Coleman, Alberta, Canada

[21] Appl. No.: 275,019

[22] Filed: Jun. 18, 1981

[51] Int. Cl.[3] ..... E21D 23/00

[52] U.S. Cl. ..... 405/300; 405/299

[58] Field of Search ..... 405/291, 295, 296, 299–301; 299/31–33

[56] References Cited

U.S. PATENT DOCUMENTS 3,383,868 5/1968 Wilkenloh et al. ..... 405/291

4,073,151 2/1978 Harmsma ..... 405/291

FOREIGN PATENT DOCUMENTS 984790 of 1965 United Kingdom ..... 405/291

*Primary Examiner*—David H. Corbin

*Assistant Examiner*—Nancy J. Pistel

*Attorney, Agent, or Firm*—Harold H. Dutton, Jr.

[57] ABSTRACT

Coal in the roof of a seam being mined by the long wall method is recovered by supporting an elongated area of the seam roof using a plurality of cradle supports, the front cradles being moved forward stepwise parallel to the long wall to form a passage with cantilevered roof supporting arms of the rear cradles. When the rear cradle at one end of the passage is moved forward into engagement with the front cradles, the coal in the roof is left unsupported, is collapsed, and is removed via a conveyor and a loader in the passage.

3 Claims, 16 Drawing Figures

22
8
10
8
1
5
3
2

10
1
5
2
3
22

10
1
5
2

10
1
5
3
3
2

10
5
3
2

10
1
5
3
2

10
1
5
3
2

10
10
1
5
3
6
2

MINING SYSTEM

BACKGROUND OF THE INVENTION

This invention relates to a mine roof support, and in particular to a mine roof support for use in coal mines.

When mining coal, using the so-called long wall method, a coal winning machine is moved along a coal face, and coal removed from the coal face by such machine is carried by a conveyor from the coal face. When using this method in the mining of a thick seam, coal is left in the top of the coal seam, i.e., the coal winning machine cannot mine the full thickness of the seam. The hydraulic supports used in long wall mining have a definite limit of vertical extension. Even though the coal winning machines can evacuate to greater heights, the usual hydraulic support has an upper limit of ten feet. If the coal seam is thicker than ten feet, a large quantity of coal can be left. The support of the present invention is intended to support the roof of the seam in a direction extending away from the coal face, and to facilitate the controlled, safe recovery of coal from the roof of the seam.

PRIOR ART

Roof supports for mine workings of generally the type disclosed herein are described, for example, in U.S. Pat. Nos. 3,446,875, issued to K. M. Groetschel on Sept. 16, 1969; 3,800,545, issued to K. M. Groetschel on Apr. 2, 1974; 3,854,293, issued to K. Spies on Dec. 17, 1974; 3,855,808, issued to G. Alacchi on Dec. 24, 1974; 3,902,325, issued to S. Sigott et al on Sept. 2, 1975; 4,020,640, issued to S. Sigott et al on May 3, 1977; 4,073,151, issued to G. Harmsma on Feb. 14, 1978; 4,143,991, issued to F. Stafford on Mar. 13, 1979; and 4,155,675, issued to H-O. Friedrichs on May 22, 1979.

As discussed in at least some of the above identified patents, attempts have been made with various degrees of success, to extract the additional coal from the roof of the seam. One method is the use of steel mesh mats on the top ends of hydraulic supports, the mats ultimately hanging behind the supports. A second armour-faced conveyor is dragged behind the supports. Coal falling behind the supports is pried onto the conveyor using bars, which are inserted through the steel mesh. Only the coal falling directly onto the conveyor or manually placed thereon is recovered. The recovery of coal, using this method, is far from complete. If the coal does not fall immediately behind the supports, when it does fall, the coal is behind the conveyor and is lost. Another problem is conveyor clogging.

The object of the present invention is to obviate or at least to alleviate the above mentioned problems by providing a relatively simple mine roof support and a method of mining using such a support.

SUMMARY OF THE INVENTION

Accordingly, one aspect of the invention involves a mine roof support comprising first cradle means, said first cradle means including first skid means for slidable mounting on a seam floor, and first prop means extending upwardly from said first skid means for supporting a section of mine roof; second cradle means including second skid means for slidable mounting on a seam floor, and second prop means extending upwardly from said second skid means for supporting the support pans of a third cradle; first coupling means interconnecting said first and second cradle means, whereby said first and second cradle means can be moved relative to each other; third cradle means including third skid means for slidable mounting on a seam floor, and third prop means extending upwardly from said third skid means for supporting a section of mine roof; and second coupling means for releasably interconnecting said second and third cradle means, whereby said third cradle means can be moved relative to said first and second cradle means.

The invention also involves a method of recovering coal from the roof of a seam adjacent to a coal face being mined by the long wall method, said recovery method comprising the steps of supporting the roof of the seam in an elongated area extending substantially parallel to said coal face; forming a passage beneath said elongated area of roof with an arched roof support; removing an end portion of said arched roof support at a location remote from said coal face at one end of said elongated area to release coal in the roof of the seam at said one end; removing roof coal from said one end through the remainder of the passage; and successively repeating the end portion and roof coal removing steps along the length of said elongated area.

BRIEF DESCRIPTION OF THE DRAWINGS

The invention will now be described in greater detail with reference to the accompanying drawings, which illustrate a preferred embodiment of each of the apparatus and method of the invention, and wherein.

DESCRIPTION OF THE PREFERRED EMBODIMENT(S)

Figure 1:
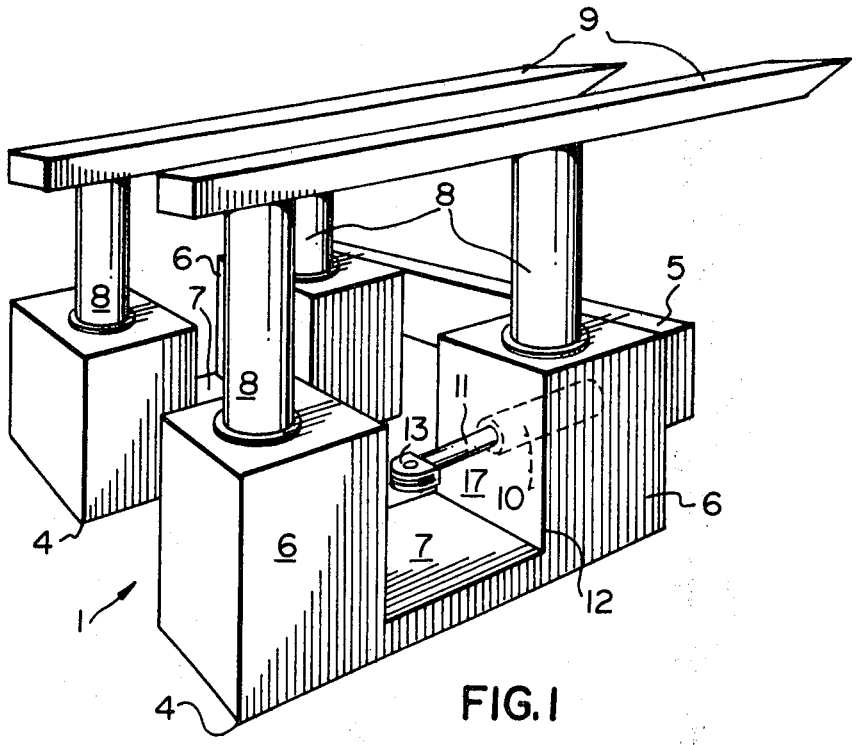
FIG. 1 is a schematic, perspective view from above of a first double-chock cradle used in the support of the present invention.
Figure 2:
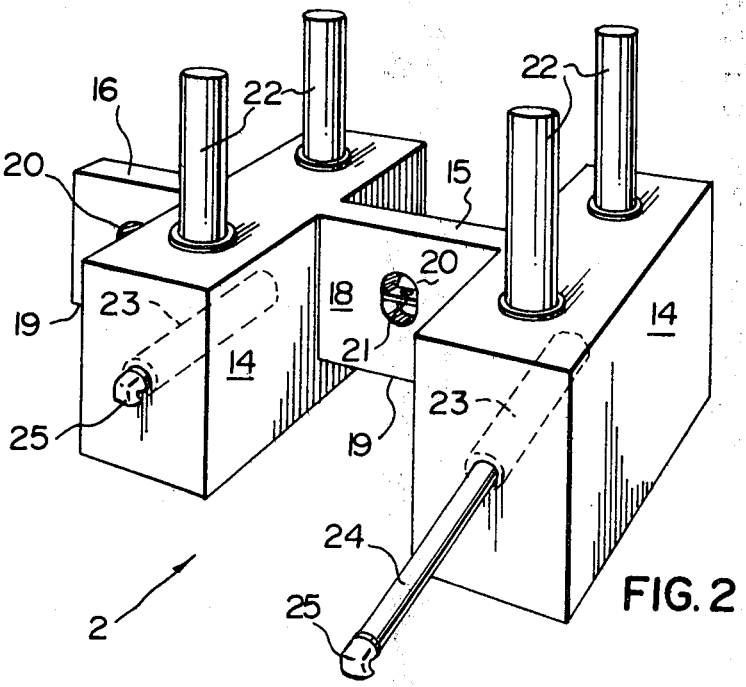
FIG. 2 is a schematic, perspective view from above of a second double cradle used in the support of the present invention.
Figure 3:
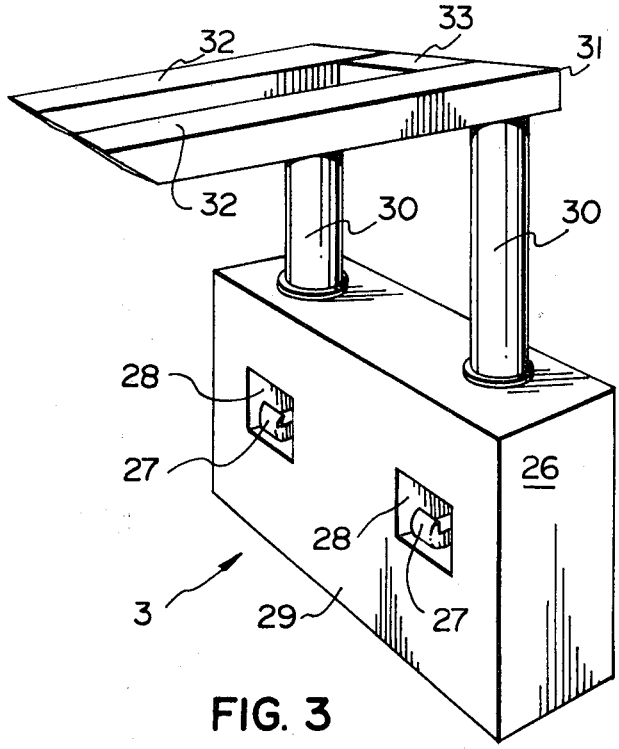
FIG. 3 is a schematic, perspective view from above of a third cradle used in the support of the present invention.
Figure 4:
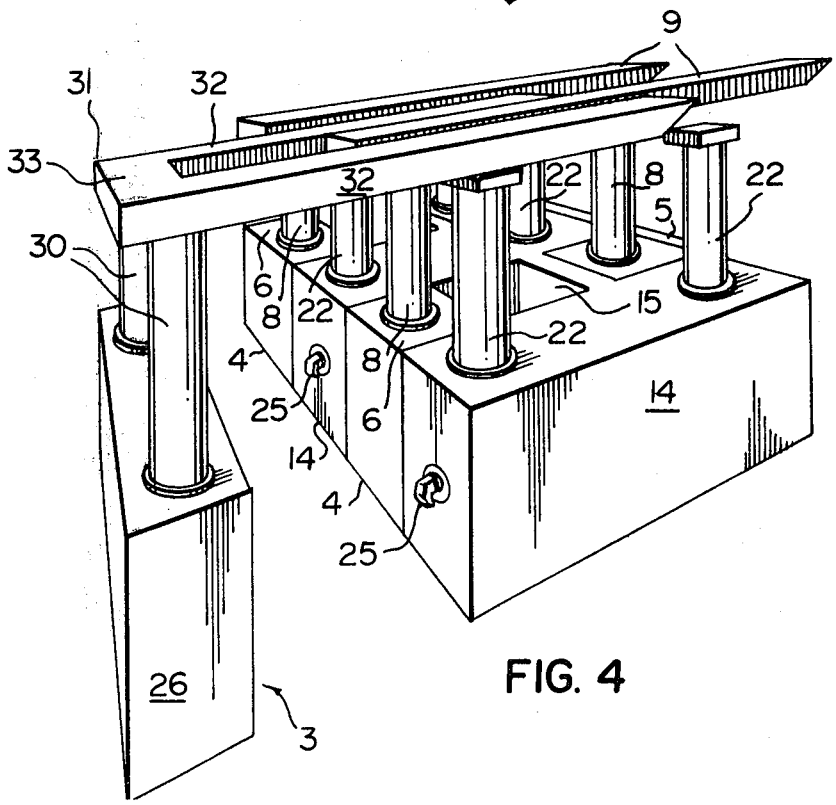
FIG. 4 is a schematic, perspective view of the support, i.e., the double-chock cradles of FIGS. 1 to 3 in the assembled condition.

With reference to FIGS. 1 to 4, the mine roof support of the present invention includes three separate cradles generally indicated at 1, 2, and 3. These may be double-chock, as illustrated, or single-chock. The cradles are defined in terms of their positions with respect to a coal face in a seam of coal. The first cradle is nearest to the coal face being mined, and the third cradle is farthest from the coal face, as described in greater detail hereinafter.

The first cradle 1, in the double-chock configuration, is defined by a pair of generally U-shaped, parallel chocks 4, which are interconnected at their front ends by a rectangular crossbar 5. The cradle 1 is rectangular when viewed from above. Each chock 4 includes corner posts 6 interconnected at their bottom ends by a web 7. The corner posts 6 act as sockets for upwardly extending hydraulic props 8. The pair of props 8 on each chock 4 support an elongated roof supporting bar 9. A hydraulic cylinder 10 (one shown) is provided in each front corner post 6, with a piston rod 11 extending rearwardly therefrom into a generally U-shaped groove 12 between the posts 6. A clevis 13 on the outer end of each piston rod 11 is used to connect the first cradle 1 to the second cradle 2.

The second cradle 2, in the double-chock configuration, includes a pair of rectangular, parallelepipedic chocks 14 interconnected by a planar, transversely extending web 15. One end of 16 of the web 15 extends beyond the outside edge of one skid 14 for abutting the opposed inner surfaces 17 of the posts 6 of the first cradle 1 during use. With the first and second cradles 1 and 2 interconnected (FIG. 4), the end 16 and central portion 18 of the web 14 ride on the webs 7 of the skids 4 of the first cradle 1. For such purpose, the bottom edge 19 of the web 15 is above the bottom edges of the skids 14. Openings 20 are provided in the web 15 in the central portion 18 and in the end 16. A plate 21 extends between the sides of each opening 20 with a hole for receiving a pin (not shown) for connecting the clevis 13 to the plate 21, and consequently the second cradle 2 to the first cradle 1. A hydraulic roof supporting prop 22 extends upwardly from each end of each chock 14. A hydraulic cylinder 23 is horizontally disposed in each chock 14, with a piston rod 24 extending rearwardly therefrom. A hook 25 on the outer end of the piston rod 24 permits connecting of the second cradle 2 to the third cradle 3.

The third cradle 3, in the double-chock configuration, includes a rectangular parallelepipedic base or chock 26. A pair of hooks 27 are disposed in recesses 28 in front face 29 of the chock 26 for engagement by the hooks 25 on the piston rods 24. A pair of hydraulic props 30 extend upwardly from within the chock 26, and a bifurcated roof supporting plate 31 is mounted on such props. Arms 32 of the plate 31 are interconnected at their rear end by a yoke 33, which maintains the spacing between the arms 32 slightly greater than the width of the bars 9 of the cradle 1. Thus, when the chock 26 of cradle 3 is slid into engagement with the rear ends of cradles 1 and 2 (FIG. 4), the arms 32 slide between bars 9 of the cradle 1.

It will be appreciated that many of the parts of the machine described hereinbefore are off-the-shelf items. While the machine has been described with reference to schematic drawings, some modifications will be required. As will become apparent in the following description of the use of the machine, it must be possible to couple and uncouple the hooks 25 and 27. While the props 22, as illustrated, do not have any top plates, in practice top roof supporting plates would usually be provided on the upper ends of the props 22.

OPERATION

Figures 5, 6, 7, 8, 9, 10, 11, 12:
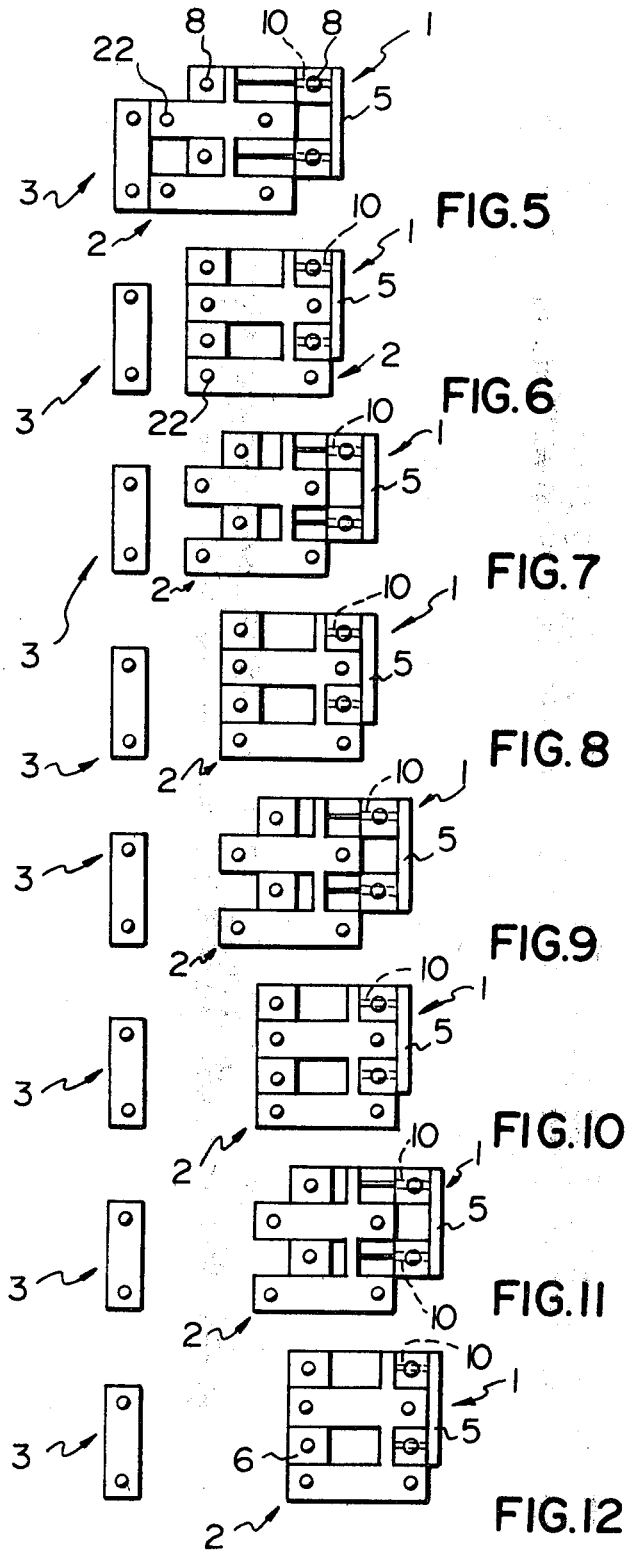
FIGS. 5 to 12 are schematic, plan views of the support of FIGS. 1 to 4, illustrating the operation of such support.

The operation of each support will now be described with reference to FIGS. 5 to 12. With the three cradles 1, 2, and 3 together, i.e., with the skid 26 abutting the rear surfaces of the chocks 4 and 14, the props 8 of the first cradle 1 are lowered and the piston rods 11 are extended to move the cradle 1 forward (FIG. 5). The props 8 are raised until the bars 9 are in roof supporting position, the props 22 of the second cradle 2 are lowered, and the piston rods 11 are retracted to move the cradle 2 forward away from the third cradle 3 (FIG. 6). The above sequence of steps is repeated (FIGS. 7 to 12) until the cradles 1 and 2 are a sufficient distance from the cradle 3 that coal retrieving equipment can pass therebetween under the canti-levered arms 32 of the third cradle 3.

It is worth noting that during forward movement of the cradles 1 and 2, the mine roof is constantly supported by the arms 32 of the third cradle 3. Moreover, in order to prevent damage to the hydraulic circuit, controls would be provided to ensure that the cylinders 10 cannot be actuated while all props 8 and 22 are fully extended under pressure. The props 22 support the arms 32 of the cradle 3 when the latter is in the forward position; for such purpose, the props 22 can be provided with top plates (shown schematically in FIG. 4).

Figure 13:
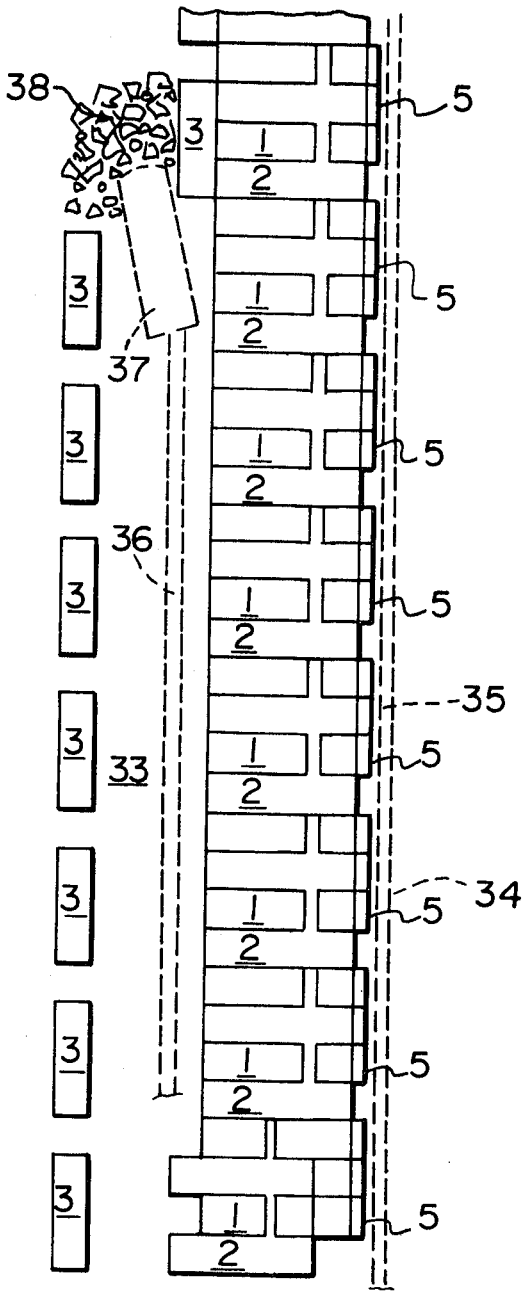
FIG. 13 is a schematic, plan view of a plurality of supports of the type illustrated in FIGS. 1 to 12 in use in a mining operation.
Figure 14:
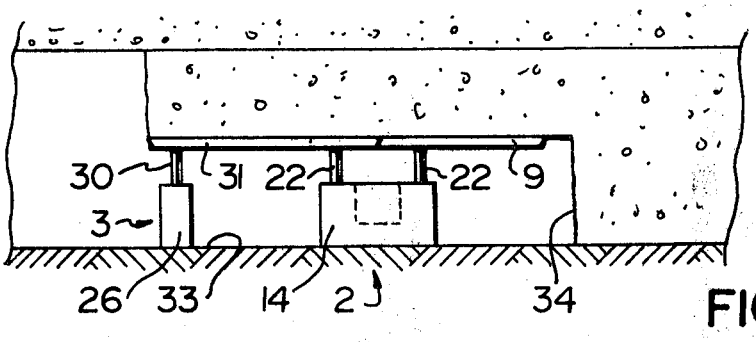
FIGS. 14 and 15 are schematic, cross-sectional views of a coal seam during a mining operation.
Figure 15:
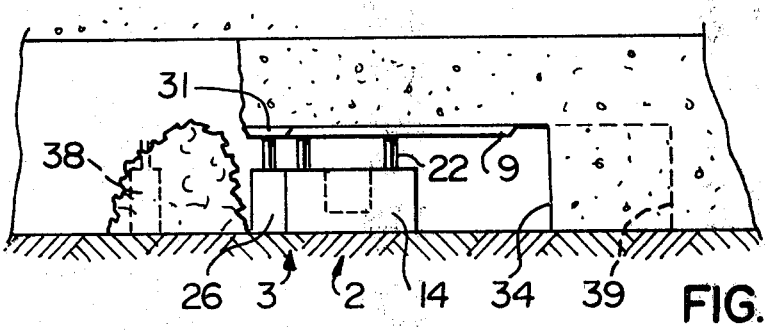
Figure 16:
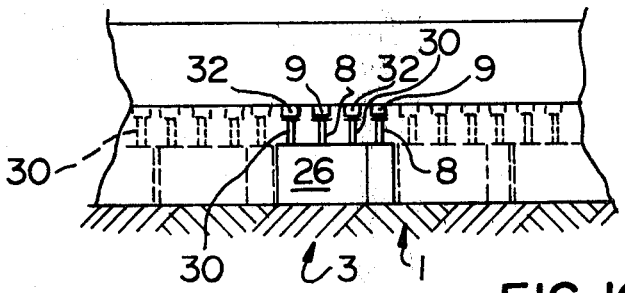
FIG. 16 is a schematic cross-sectional view taken generally at a right angle to the cross-section of FIGS. 14 and 15.

An actual mining operation is depicted in FIGS. 13 to 16. Using the method described above, a row of cradles 1 and 2 is spaced from a row of cradles 3 in a coal seam to define an elongated passage 33 beneath the arms 32. The passage 33 is located rearwardly of long wall 34 of the seam which is being mined using conventional coal winning equipment (not shown) including a conveyor 35 (FIG. 13). The passage 33 is sufficiently wide that a conveyor 36 and a coal loader 37 can pass therethrough. By extending the piston rods 24 so that the hooks of the cradle 2 couple with the hooks 27 of the cradle 3, retracting the props 30 to move the arms 32 of roof supporting position, and then retracting the piston rods 24, the cradle 3 is moved forward into engagement with the rear ends of the cradles 1 and 2. Such action leaves the section of the roof in the rear of the cradle 3 unsupported. The coal in such roof section either falls or is knocked down by cutting, drilling or blasting to form a pile 38 (FIGS. 13 and 15) in the rear of the cradle 3. The coal in the pile 38 is removed using the conveyor 36 and the loader 37, and the next cradle 3 is moved forward to leave another section of roof unsupported. These steps are repeated along the entire length of the passage 33. By mining the long wall 34, a new coal face 39 (FIG. 15) is reached, and then the steps of (1) moving cradles 1 and 2 forward stepwise to form a new passage 33 with an arched roof support, and (2) moving the cradles 3 forward sequentially, i.e., removing end portions of the arched roof support to release more roof coal.

Further modifications and alternative embodiments of the invention will be apparent to those skilled in the art in view of the foregoing description. Accordingly, this description is to be construed as illustrative only and is for the purpose of teaching those skilled in art, the manner of carrying out the invention. It is further understood that the form of the invention herewith shown and described is to be taken as the presently preferred embodiment. Various changes may be made in the shape, size and general arrangement of components, for example, the application, as illustrated, is for the strongest ten post layout. For mine conditions where pressures are lower, single-chock cradles may be used. Equivalent elements may be substituted for those illustrated and described herein, parts may be used independently of the use of other features, all as will be apparent to one skilled in the art after having the benefits of the description of the invention.

What I claim is:

1. A mine roof support comprising first cradle means including a first pair of spaced apart chocks for slidable mounting on a seam floor, a crossbar interconnecting said first pair of chocks and first prop means extending upwardly from said first cradle means and including roof supporting bars for supporting a section of mine roof; second cradle means including a second pair of spaced apart chocks for slidable mounting on a seam floor, a web interconnecting said second pair of chocks, and second prop means extending upwardly from said second cradle means for supporting a section of mine roof; first coupling means interconnecting said first and second cradle means for moving said first and second cradle means relative to each other and toward or away from a longwall mining face; said first chocks and said web being so shaped that said first and second cradle means are slidably interconnected in overlapping relationship with said first and second pairs of chocks parallel to each other; third cradle means including third chock means for slidable mounting on a seam floor, and third vertically movable props extending upwardly from said third chock means; said third props including roof supporting arms so spaced apart that they are parallel to and between said bars for supporting a section of mine roof; second coupling means for releasably interconnecting said second and third cradle means for moving said third cradle means relative to said first and second cradle means and for providing a working passage beneath said third prop means and between said first and second chock means and said third chock means.

2. A mine roof support according to claim 1, wherein said first prop means includes vertically movable props extending upwardly from said first chocks; and roof supporting bars on said first props.

3. A mine roof support according to claim 1, wherein said arms are canti-levered with respect to said third props and third chock, whereby when said third cradle means is spaced from said first and second cradle means with the arms extending toward the first and second cradle means, the first, second and third cradles and said arms define an arched passage.

* * * * *